United States Patent [19]

Bartels et al.

[11] 4,072,275

[45] Feb. 7, 1978

[54] SAMPLE PREPARATION DEVICE

[75] Inventors: Hermann Bartels, Binningen; Werner Schürmann, Greifensee; Max Sigg, Weisslingen, all of Switzerland

[73] Assignee: Mettler Instruments AG, Greifensee, Switzerland

[21] Appl. No.: 732,915

[22] Filed: Oct. 18, 1976

[30] Foreign Application Priority Data

Dec. 5, 1975 Switzerland ..... 15839/75

[51] Int. Cl.[2] ..... B02C 23/36

[52] U.S. Cl. ..... 241/79; 241/199.12; 209/453

[58] Field of Search ..... 241/41, 46 R, 46 B, 241/46.13, 79, 79.2, 79.3, 199.11, 199.12; 209/199, 453, 465

[56] References Cited

U.S. PATENT DOCUMENTS

| | | | |
|---|---|---|---|
| 2,125,663 | 8/1938 | Wuensch | 241/41 |
| 2,695,133 | 11/1954 | Drury | 209/453 |
| 2,858,064 | 10/1958 | Clow et al. | 209/453 |
| 2,903,198 | 9/1959 | Asplin | 241/199.12 |

FOREIGN PATENT DOCUMENTS

| | | |
|---|---|---|
| 2,310,663 | 10/1974 | Germany. |

*Primary Examiner*—Granville Y. Custer, Jr.
*Attorney, Agent, or Firm*—Werner W. Kleeman

[57] ABSTRACT

A sample preparation device comprising a wet mill having a lower discharge opening for discharging crushed wet material from the mill. A continuous flow centrifuge is arranged at a lower level than the mill. Flow means provide a direct communication between the discharge opening and the centrifuge for the direct transfer of the crushed wet material from the mill into the centrifuge.

7 Claims, 5 Drawing Figures

Fig. 4
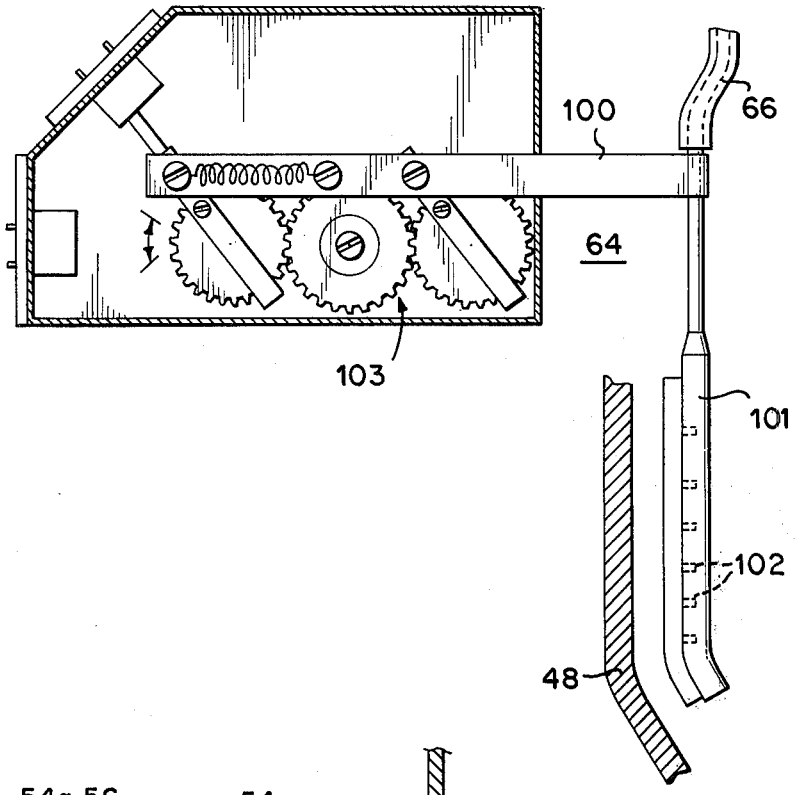
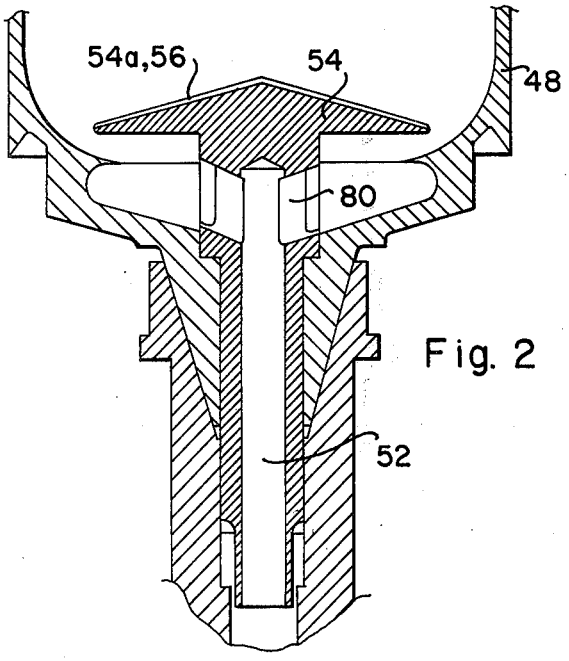
Fig. 2

Fig. 5
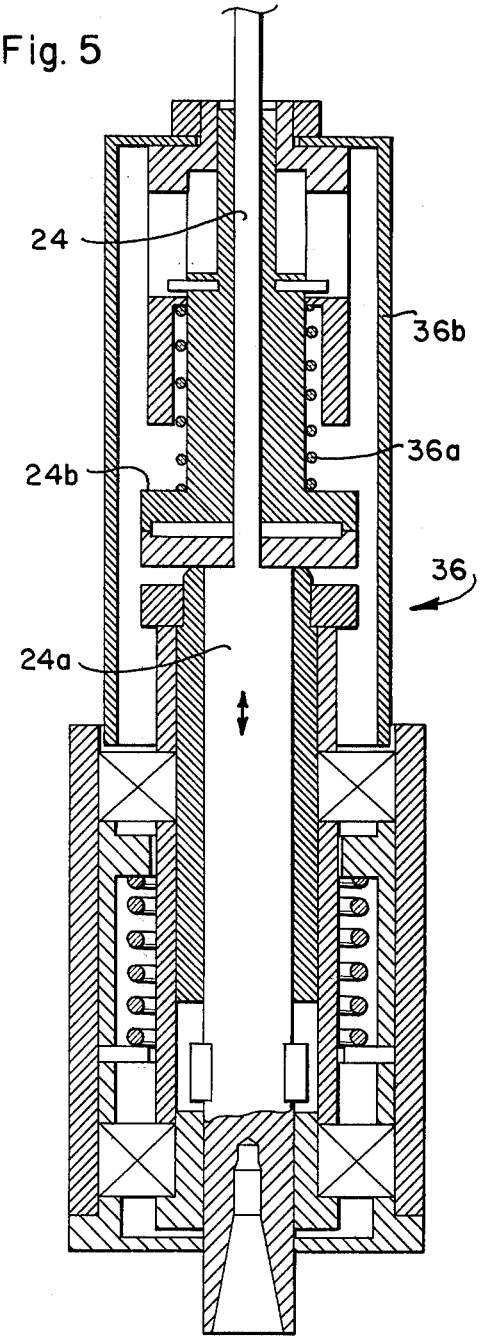
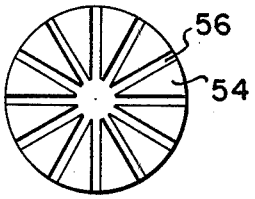
Fig. 3

SAMPLE PREPARATION DEVICE

BACKGROUND OF THE INVENTION

The present invention relates to a new and improved construction of a sample preparation device for an analytical laboratory.

Before an analysis operation can be carried out on a sample, the sample must be put into a form which is suitable for the method of analysis to be used, for example a solution. However, the starting substance available is frequently a solid substance, which must therefore be crushed and dissolved or extracted. Heretofore the crushing operation was often carried out by means of a mortar and pestle or by means of a ball mill, the crushed sample then being dissolved or extracted, and finally the remaining residue being separated off by filtering. Some devices have been proposed which operate with ultrasonic or mechanical grinding mechanism to which the solvent is added so that the dissolving or extracting operation is carried out during the crushing operation. The resulting suspension is then, typically, taken from the crushing mechanism and fed to a filter or a centrifuge, by means of suitable intermediate containers for carrying the sample from the crushing mechanism to the filter or centrifuge.

A typical mode of operation as briefly set out above suffers from a number of fundamental weaknesses. The fact that the sample must be taken backwards and forwards by means of intermediate containers, possibly a number of times, between the individual devices (for example the mill and the filter device) involves a relatively expensive, tedious and complicated procedure. In addition the danger of contamination of the sample when transferring it from one device to the other is great, for example residues of one sample can be carried over into another sample, unless extreme care is taken, and this in turn has a direct effect on the time required for and the cost of the analysis operation. In addition, the number of times that a sample is transferred influences the degree of precision of analysis, due to losses of the original substance.

SUMMARY OF THE INVENTION

Hence, it is a primary object of the present invention to provide a new and improved construction of sample preparation device which is not associated with the aforementioned drawbacks and limitations of the prior art proposals.

Another and more specific object of the present invention aims at simplifying preparation of a sample, especially during discontinuous solid-liquid extraction, but also for the dissolving and/or extraction of pasty substances, and to reduce the danger of contamination of the sample and the time required to prepare the same.

In keeping with the foregoing it is a further object of the present invention to also reduce the manipulation time in handling the sample and to maintain small the constructional expenditure in the equipment.

Now according to the present invention, there is provided a sample preparation device comprising a wet mill having a lower discharge opening for discharging crushed wet material from the mill. A continuous flow centrifuge is arranged at a lower level than the mill. Flow means provide a direct communication between the discharge opening and the centrifuge for the direct transfer of the crushed wet material from the mill into the centrifuge.

Preferably the mill and the centrifuge are arranged coaxially one above the other, while the mill has a discharge pipe which is also arranged coaxially and which impinged directly on a material-distributor member in the centrifuge. This provides a compact arrangement, and any additional hose or pipe connection between the mill and the centrifuge is unnecessary.

In one embodiment of the device, the mill can include a one-piece pestle or crushing member which has an upper end portion coupled to a mill drive means and a tapered crushing or grinding portion carrying a coaxial lower end shaft portion which is displaceable virtually sealingly in the discharge pipe. The crushing member is coupled to a drive for vertical displacement in the mill casing. This arrangement affords the advantages that the pestle can be set in a plurality of positions, for example a raised position which liberates the crushing or grinding chamber for introduction of the sample, a lowered position which is the crushing position, and an intermedite position in which the crushed material is extracted with a solvent and the resulting suspension is homogenised. During this operation the mill is virtually self-sealing at the bottom, by virtue of the close sealing cooperation of the lower end shaft portion and the discharge pipe. In addition, the pestle can be easily lifted, for example for inspection purposes.

BRIEF DESCRIPTION OF THE DRAWING

The invention will be better understood and objects other than those set forth above, will become apparent when consideration is given to the following detailed description thereof. Such description makes reference to the annexed drawing wherein

FIG. 2 is a fragmentary sectional view of part of the continuous flow centrifuge used in the arrangement of FIG. 1;

FIG. 3 is a plan view of a detail of the continuous flow centrifuge of FIG. 2;

FIG. 4 is a fragmentary view, partially in section, showing details of the cleaning device used in the arrangement of FIG. 1; and FIG. 5 is a fragmentary sectional view illustrating details of an impact or battering of the arrangement of FIG. 1.

DETAILED DESCRIPTION OF THE PREFERRED EMBODIMENTS

Figure 1:
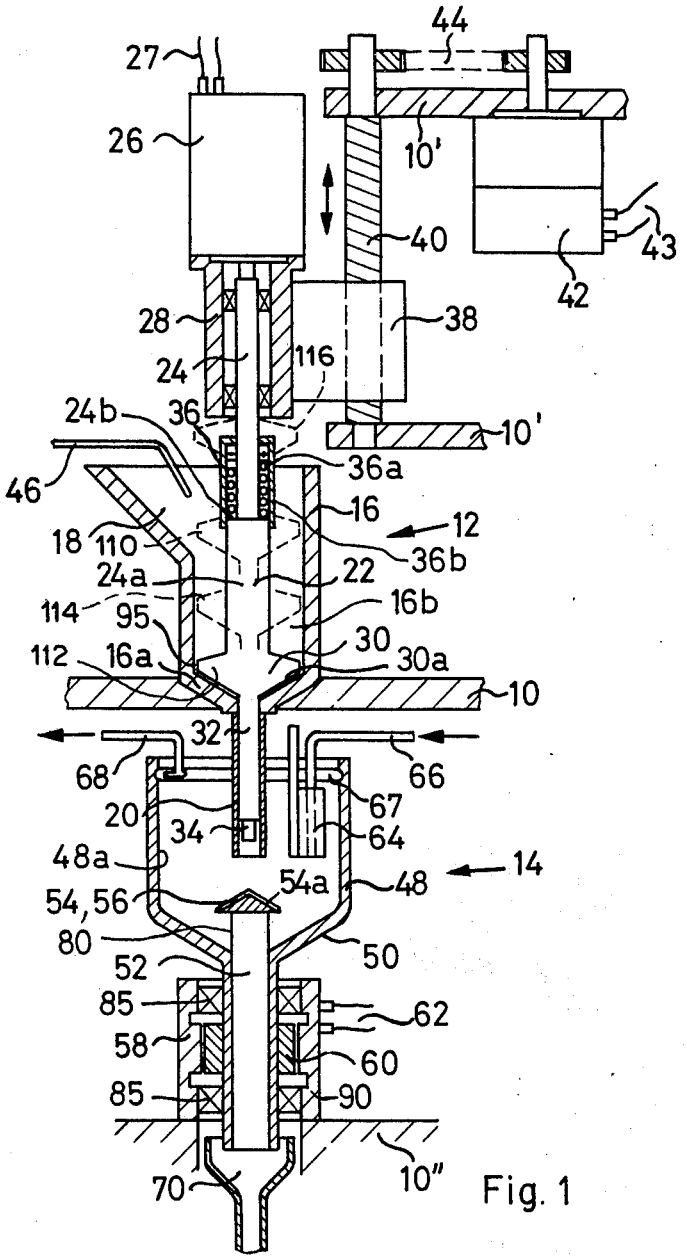
FIG. 1 illustrates a preferred exemplary embodiment, partially in cross-sectional view, of a sample preparation device constructed according to the teachings of the invention showing purely schematically four different possible positions of the crushing member of pestle thereof.

Referring to the drawing, a common mounting of which only some portions 10, 10', and 10'' are shown carries a crushing mechanism or mill 12 and a centrifuge 14 which is arranged below and substantially coaxially with the mill 12.

The mill 12 includes a cylindrical mill casing 16 which is enlarged to one side at its upper end portion to form a filling opening 18, while at its lower end **16*a* the casing 16 converges frusto-conically and communicates with a substantially coaxial discharge pipe 20. The inner or upper surface of the frustoconical lower end portion 16*a* of the casing 16 forms a crushing surface, and in order to increase the crushing effect, the crushing surface may be slightly roughened. A crushing member or pestle 22 is shown within the casing 16, in three alternative positions, as will be described more fully below. The pestle 22 is made in one-piece and includes a plurality of portions, namely: a relatively thin upper shaft end portion 24 which is connected to a mill drive 26 and which is mounted by means of ball bearing assemblies in a support sleeve 28; an enlarged and strengthened middle shaft portion 24***a*; and a crushing portion 30 adjoining the middle portion 24*a*. The crushing surface 30*a* of the crushing portion 30, which may also be slightly roughened, is tapered to essentially correspond to the taper of the lower end portion 16*a* of the mill casing 16. Further, the outside diameter of the crushing portion 30 is some tenths of a millimeter smaller than the internal diameter of the casing 16. Finally, the pestle or crushing member 22 has, at its lower end, a shaft end portion 32 which is thinner than the crushing portion 30. The shaft end portion 32 projects with a slight clearance into the discharge pipe 20, and virtually entirely fills such discharge pipe 20 in it axial direction, when the mill is in the crushing position in which the crushing member 30 is in its solid-line position, as shown. The crushing surface 30*a* of the crushing member 30 also can be provided in known manner with shearing blades or edges, while the free end of the shaft portion 32 is provided with a reduced-diameter turned portion or spigot 34. Reference numeral 27 denotes leads connecting the mill drive 26 to conventional power supply and control means (not shown).

As best seen by referring to FIG. 5, at the transition between the upper shaft end portion 24 and the middle shaft portion 24*a*, the pestle or crushing member 22 passes through an impact or loading mechanism 36 including a compression spring 36*a* which is held in a sleeve 36*b* and which bears at one end against the shoulder 24*b* of the shaft middle or transition portion 24*a*, to urge the pestle 22 downwardly.

A nut 38 fixedly connected to the side of the sleeve 28 on the mill drive 26 is carried vertically movably on a screw-threaded rotary spindle 40 which passes through the nut 38 and which is mounted rotatably in the mounting frame portions 10'. A drive motor 42 with transmission 44 is connected to the spindle 40 to rotate the same to cause vertical movement of the traveling nut 38 and, thus, also the drive 26 and the crushing member 30, as shown by the vertical double-headed arrow. Reference 43 denotes leads connecting the drive motor 42 to conventional power supply and control means (not shown).

A conduit 46 for supply of solvent opens above the filling opening 18, adjacent to the lengthwise axis of the pestle 22. The conduit 46 can be connected with a multiple feed and metering unit, so that a plurality of different solvents can be selectively introduced into the mill 12 by way of the conduit.

Continuing, the centrifuge 14 — which constitutes the subject matter of our commonly assigned copending U.S. application Ser. No. 731,457, filed Oct. 12, 1976, and entitled "Continuous Flow Centrifuge", the disclosure of which is incoporated herein by reference — and as shown in FIGS. 1 and 2 comprises an upwardly open substantially cylindrical casing 48 and an adjoining frusto-conical lower portion 50 which communicates with a hollow shaft 52. Extending upwardly from the hollow shaft 52 is a support arrangement 80 for instance in the form of four supports which carry a distributor member or mushroom 54 (FIGS. 2 and 5). The member 54 has a conically upwardly converging surface 54*a* in which are formed for instance twelve grooves 56 (FIG. 3), for accelerating the suspension. The shaft 52 is mounted by means of ball bearing assemblies 85 in a stationary part such as the stator casing 90 of a drive motor 58 which, in this embodiment, is a cage rotor-asynchronous motor, the shaft 52 thus forming a drive shaft for the centrifuge 14. The rotor 60 of the drive motor 58 is conveniently fixed on the shaft 52, so that the shaft 52 is in effect a component of the rotor, which provides a simple and compact drive construction. The entire assembly of the rotor 60 and the centrifuge 14 is fixed on a mounting member 10'' by way of the drive motor 58. Leads 62 connect the drive motor 58 to its power supply and control means.

The stationary feed pipe 20 forming part of the mill 12 opens downwardly towards the distributor member 58 substantially coaxially therewith and at a small vertical spacing therefrom. As shown in FIGS. 1 and 4, a cleaning device 64 is provided adjacent to the pipe 20, eccentrically relative thereto. The cleaning device 64 includes a rigid holder 100 mounting a brush head 101 which has discharge nozzles 102 passing through it, as explained more fully in our aforementioned copending application. The nozzles 102 can be supplied with washing liquid by way of a conduit 66. The entire cleaning device 64 is arranged for cleaning purposes so as to be displaceable vertically and horizontally, i.e. radially relative to the feed pipe 20, by means of for instance standard gearing comprising the set of gear wheels 103 so that the holder 100 moves the brush head 101 as it moves to-and-fro within a small sector as indicated by the double arrow.

A skimming pipe 68 is provided for taking-off clear liquid which in operation has been collected in a collecting channel 67 in the upper part of the casing 48. The pipe 68 may be adjustable radially in the casing 48, and/or it may be adjustable in its angle of incidence to the channel 67. A discharge pipe 70 communicates with the hollow shaft 52 for the discharge of solid material that has been separated out, as will be described below.

A typical operating cycle is as follows:

First of all the mill 12 is accelerated to its operating speed of rotation (for example 900 rpm), and the lifting drive arrangement 38 to 44 is so actuated that the pestle 22 is lifted into the next uppermost position shown in dotted lines in FIG. 1 and generally indicated by reference character 110. A sample to be extracted is now introduced into the mill manually or mechanically, through the feed opening 18. Depending on the circumstances of the individual case, the sample can be introduced in one lot or piece or in the form of coarse-grain or fine-grain amounts, in a dry condition, or in the form of a suspension. Possibly after flushing out of the sample container to ensure that the sample is transferred into the mill without leaving any residue in the container, a predetermined amount of solvent is added by way of conduit 46 and the pestle or crushing member 22 is lowered into the lowermost crushing position shown in solid lines in FIG. 1 and generally indicated by reference character 112. In this position 112 there is only a narrow annular gap 95 between the crushing portion 30 and the mill casing 16, so that uncrushed particles cannot escape from the crushing chamber 166 in the casing 16. The gap will substantially correspond to the desired fineness of crushing.

After an empirically predetermined crushing time has expired, the pestle or crushing member 22 is raised into an intermediate or middle position shown in dotted lines in FIG. 1 and generally indicated by reference character 114, while still being rotated. The mixture is now dispersed (homogenised) in the crushing chamber 16b in the casing 16, and simultaneously extracted. The mixture cannot escape from the mill as it is virtually sealed by the shaft portion 32 in the pipe 20. After the time allowed for this operation, the pestle 22, while still rotating, is raised further into a fourth uppermost position, generally indicated by dotted lines in FIG. 1 by reference character 116 above the next uppermost position 114 shown in dotted lines in FIG. 1, until the portion 34 at the lower end of the pestle 22 is disposed within the crushing chamber 16b and opens a throughflow opening for the suspension to flow into the pipe 20. The size of this opening can be finely controlled by adjustment of the precise position of the pestle or crushing member 22 in a vertical direction, thereby permitting precise metering of the slurry or suspension into the centrifuge 14.

The centrifuge 14 is accelerated to its operating speed of rotation (for example 15,000 rpm) simultaneously with the mill 12. This is done so that any solvent which escapes from the casing 16 through the annular gap between the shaft end portion 32 and the internal surface of the pipe 20 is not directly lost through the discharge pipe 70, but, due to the rotation of the centrifuge casing 48, follows the designed path in the centrifuge to the collecting channel 67.

The suspension which has been fed to the centrifuge through the pipe 20 impinges on the distributor member 54 and into the grooves 56 which impart a preliminary acceleration to the suspension in throwing it outwardly towards the casing 48. The rate at which the suspension is introduced into the centrifuge 14 can be about 20 ml per minute. During the suspension feeding operation, the suspension is kept virtually completely homogenous due to the continuing rotation of the pestle 22, so as to provide for substantially complete transfer of the suspension into the centrifuge 14. In this phase of operation the pestle 22 acts like a rotary valve.

When the operation of transferring the suspension into the centrifuge 14 is concluded, the pestle 22 is lowered into the filling position (the next uppermost position 110 shown in dotted lines in FIG. 1), and a further volume of solvent acting as a washing liquid is introduced by way of the conduit 46. The washing liquid impinges on the top side of the crushing portion 30 and is accelerated radially due to the rotation of the pestle 22. The pestle 22 is temporarily lowered into the lowermost grinding position 112 during this washing operation so that, as the rotating pestle moves downwardly, the resulting spray of liquid from the pestle exerts a uniform and vigorous washing action along the height of the mill casing and at the same time effects residue extraction of any solid substance which may still be present in the crushing chamber 16b. The pestle or crushing member 22 is then lifted again into a transfer position the fourth uppermost position 116 so that the washing liquid (and with it also any solid particles which may possibly have remained in the mill 12) pass into the centrifuge 14. This procedure provides for good cleaning of the mill 12, with a simultaneous residue extraction effect, at the beginning of the washing operation, for extracting any remaining solid components which still may be present. After the operation of transferring the residue suspension is concluded, the mill 12 can be stopped.

Due to the high speed of rotation of the centrifuge 14, a layer or bank of solid material builds-up very rapidly after the beginning of the separating operation, at approximately the height of the distributor member 54, on the internal surface 48a of the centrifuge casing 48. Slurry or suspension which is subsequently introduced into the centrifuge 14 for the main part passes through this bank, which thus provides an additional extracting effect, by a percolation action.

Clear liquid which has been separated out by centrifuging collects in and is drawn-off at the collecting channel 67 by the pipe 68, and carried away for further processing. After the separating operation has been concluded, the speed of rotation of the centrifuge 14 is reduced to about 100 rpm and the cleaning device 64 is moved into contact with the casing 48 and moved up and down in the casing. At the same time washing solution issues from the brush nozzles 102, so that the dissolved solid material washed off the casing 48 is flushed through the shaft 52 and the discharge pipe 70. After the cleaning operation has been concluded, the centrifuge 14, which is now ready for the next operating cycle, can be stopped. The shaft 52 thus forms a conduit for discharge of one separated phase, usually the solid phase, from the centrifuge, as well as forming the drive shaft.

The above-described device is distinguished by a good homogenisation and extraction action, and the reproducibility of the results is high. By virture of its rapid operation, in conjunction with a suitably designed control means (which is not part of the present invention), the device is particularly well suited for individual analysis operations, that is to say, for dealing with kinds and consistencies of samples that frequently change. Based on empirical values, for example computer-supported programs can be employed, which optimise the time required and automatically initiate any control functions.

The robust structure of the mill, together with the loading mechanism 36 with which it is provided, permits for example ointments in a glass container to be introduced into the mill, together with their glass containers, so that even problems in this respect, in regard to simple and complete transfer, can be easily overcome. Thus, when a glass container with ointment is introduced into the mill 12, the glass container is crushed into very small particles and separated out in the centrifuge, after dissolution or extraction of the ointment. The construction with loading mechanism also makes it possible to crush material which is initially of very irregular grain size. It will be noted that the crushing portion 30, in the crushing position, is surrounded by the cylindrical casing wall of the mill, forming therewith an annular gap whose width approximately corresponds to the desired fineness of grinding. This ensures that on the one hand even very coarse material, for example entire tablets of material, can be crushed, but on the other hand no uncrushed material can escape from the crushing chamber, between the crushing portion 30 and the casing.

The construction of the mill 12 with four possible operating positions 110, 112, 114 and 116 for the pestle or crushing member 22 means that the device is particularly versatile in its range of possible use and, due to the possibility of fine adjustment of the pestle 22 as regards its transfer position, can overcome in particular the problem of correct metering of material when feeding the centrifuge.

In principle, it is also possible for the mill and the centrifuge not to be arranged coaxially, if for example considerations of space point to the device being arranged in such a fashion, provided that the centrifuge is at a lower level than the mill for the direction transfer of material from the mill to the centrifuge. It will be appreciated that in that case transfer of the samples from the mill to the centrifuge becomes somewhat more complicated and expensive.

The above-described device can be used for preparing samples, such as for discontinuous solid/liquid extraction, for the dissolution and/or extraction of pasty substances, while reducing the danger of sample contamination and reducing the amount of time required. It will be appreciated that the device provides for automatic controllable transfer of the sample from the mill to the centrifuge, without any detour, and the device can thus carry out all the functions considered herein: namely crushing, dissolving or extraction, homogenisation, and separation.

While there are shown and described present preferred embodiments of the invention, it is to be distinctly understood that the invention is not limited thereto, but may be otherwise variously embodied and practiced within the scope of the following claims.

Accordingly, we claim:

1. A sample preparation device comprising a wet mill having a lower discharge opening for discharging crushed wet material from the mill, a continuous flow centrifuge arranged at a lower level than the mill, flow means providing a direct communication between said discharge opening and said centrifuge for the direct transfer of the crushed wet material from the mill into the centrifuge, mill drive means, the mill including a mill casing internally provided with a one-piece crushing member which comprises an upper end portion connected to said mill drive means, a substantially frusto-conical crushing portion, and a lower shaft end portion which is substantially sealingly displaceable in said discharge pipe, and drive means for vertical displacement of the crushing member in said mill casing.

2. The device according to claim 1, wherein the lower shaft end portion has a reduced portion at its lowermost end.

3. The device according to claim 1, wherein the drive means is capable of displacing the crushing member and its crushing portion into a crushing position, the mill casing comprises a substantially cylindrical casing wall, the mill including a loading mechanism for the crushing member, said crushing portion, when in its crushing position, being surrounded by said substantially cylindrical casing wall of the mill, said crushing portion forming, in said crushing position, together with the cylindrical casing wall of the mill, an annular gap whose width approximately corresponds to the desired fineness of crushing.

4. The device according to claim 1, further including supply conduit means opening into the mill above a top surface of the crushing portion for feeding solvent into the mill.

5. A sample preparation device comprising a wet mill having a lower discharge opening for discharging crushed wet material from the mill, a continuous flow centrifuge arranged at a lower level than the mill, flow means providing a direct communication between said discharge opening and said centrifuge for the direct transfer of the crushed wet material from the mill into the centrifuge, said centrifuge includes a substantially cylindrical casing possessing an essentially circular cross-sectional configuration, said cylindrical centrifuge casing having a lower portion terminating in a substantially coaxial hollow shaft which provides both for driving the centrifuge and also for the discharge of a phase from the centrifuge.

6. The device according to claim 5, further including a drive motor including a rotor for driving the centrifuge, said hollow shaft constituting a component of said rotor.

7. A sample preparation device comprising a wet mill having a lower discharge opening for discharging crushed wet material from the mill, a continuous flow centrifuge arranged at a lower level than the mill substantially coaxially therewith, said centrifuge being provided with a substantially centrally disposed distributor member for distributing said material within the centrifuge, and flow means providing a direct communication between said lower discharge opening and said centrifuge, said flow means comprising a discharge pipe arranged substantially coaxially above and opening onto said distributor member for the direct transfer of the crushed wet material from the mill to the centrifuge.

* * * * *